United States Patent [19]

Bobrowski

[11] Patent Number: 4,818,000

[45] Date of Patent: Apr. 4, 1989

[54] DECORATIVE SURFACE BOLT

[75] Inventor: Louis G. Bobrowski, Berlin, Conn.

[73] Assignee: The Stanley Works, New Britain, Conn.

[21] Appl. No.: 130,549

[22] Filed: Dec. 9, 1987

[51] Int. Cl.[4] ..... E05C 1/10

[52] U.S. Cl. ..... 292/147; 292/DIG. 38; 292/DIG. 51; 292/DIG. 57; 292/337

[58] Field of Search ..... 292/147, 152, 337, 357, 292/DIG. 38, DIG. 51, DIG. 57, 137, 145, 153, 148

[56] References Cited

U.S. PATENT DOCUMENTS

| | | | |
|---|---|---|---|
| D. 233,821 | 12/1974 | Dahl et al. | D8/7 |
| 758,333 | 4/1904 | Pfleghar . | |
| 1,496,822 | 6/1924 | Moore | 292/147 |
| 1,646,136 | 10/1927 | Booth . | |
| 1,653,015 | 12/1927 | Koelln . | |
| 2,100,622 | 11/1937 | Adams | 292/145 |
| 2,247,556 | 7/1941 | Lazarides | 292/152 |
| 2,841,974 | 7/1958 | Hensel | 70/134 |
| 2,971,789 | 2/1961 | Weaver | 292/145 |
| 3,095,617 | 7/1963 | Bruno . | |
| 3,126,218 | 3/1964 | Andrews | 292/175 |
| 3,347,581 | 10/1967 | Hann | 292/147 |
| 3,405,960 | 10/1968 | Wargo | 292/145 |
| 3,469,875 | 9/1969 | Ahlgren | 292/DIG. 38 X |
| 3,825,289 | 7/1974 | Armstrong | 292/2 |
| 4,193,619 | 3/1980 | Jerila | 292/168 |
| 4,429,495 | 2/1984 | Aoki | 49/501 |

FOREIGN PATENT DOCUMENTS

| | | | |
|---|---|---|---|
| 340933 | 9/1921 | Fed. Rep. of Germany | 292/147 |
| 1582372 | 1/1981 | United Kingdom | 292/147 |

*Primary Examiner*—Richard E. Moore

[57] ABSTRACT

A decorative surface-mounted latch bolt assembly includes a decorative housing, a chassis providing an elongated passage therewithin, and a guide member disposed within the passage of the chassis and providing an elongated channel in which is seated the latch bolt. The guide member is fabricated of synthetic resin and its passage is configured and dimensioned to snugly receive the latch bolt so as to preclude its rattling or inadvertent movement therewithin. An actuator is supported above the top surface of the housing, and a connecting element extends between the actuator and the latch bolt through registering openings in the top wall of the housing, the chassis and the guide member, and these apertures are elongated so as to permit the desired longitudinal movement of the latch bolt.

14 Claims, 2 Drawing Sheets

DECORATIVE SURFACE BOLT

BACKGROUND OF THE INVENTION

The present invention relates to surface mounted latch bolts and more particularly to such latch bolts which employ a decorative housing to conceal the operating mechanism.

Latch bolts are widely employed for effecting locking action of doors, gates, and the like. Generally such latch bolts will employ a body element which provides a passage in which the latch bolt is slidable for a limited distance and which also functions to provide the means for securing the latch bolt assembly to the supporting surface. Decorative latch bolt assemblies will normally include some form of housing enclosing this body element, and some form of knob connected to the latch bolt must be provided outwardly of the decorative housing so as to permit the manipulation of the latch bolt.

A common problem in such latch bolt assemblies is the fact that the latch bolt is generally loosely retained and may rattle. Moreover, the acts of opening and closing the door will sometimes cause the latch bolt to move out to an extended position wherein it will strike the edge of the latch plate or the surface of the wall into which the door is being moved. Moreover, in some instances, the very act of closing the door rapidly may throw a loose latch bolt into inadvertent engagement with the cooperating latch although no such locking action is desired. If the latch bolt is held tightly within its housing; then it may be difficult to move inwardly and outwardly to effect the latching and unlatching action.

Other common problems are the rattling or noise created by movement of the "loose" bolt in the metal housing, and the moving of the surfaces of the latch bolt as it slides inwardly and outwardly of its housing.

It is an object of the present invention to provide a novel decorative surface-mounted latch bolt assembly providing a highly attractive appearance and affording smooth, reliable action of the latch bolt.

It is also an object to provide such a latch bolt assembly which may be fabricated readily from components which are rugged and relatively simple to fabricate and which provide a secure and long lived assembly.

Another object is to provide such a latch bolt assembly wherein the latch bolt is releasably retained within an element which eliminates rattling and minimizes scruffing of its surface.

SUMMARY OF THE INVENTION

It has now been found that the foregoing and related objects and advantages may be readily attained in a decorative surface-mounted latch bolt assembly which has a base member with a top wall and depending sidewalls defining a channel therebetween. The top wall has an aperture therein extending parallel to the channel, and seated in this channel is a guide member of synthetic resin having a top wall and side walls extending parallel to the channel of the base member. This guide member provides a channel extending parallel to the channel of the base member, Its top wall has an aperture therein aligned with the aperture of the base member. Slidably seated in the channel of the guide member is a latch bolt.

Disposed over the base member is a decorative housing having a top wall and a sidewall extending downwardly therefrom about the base member. The top wall has an aperture therein aligned with the apertures in the top walls of the base member and guide member, and its sidewall provides an aperture aligned with one end of the channels and dimensioned and configured to permit the latch bolt to pass freely therethrough. An actuator member is disposed above the top wall of the decorative housing and overlies the aperture therein, and it is engaged with the latch bolt through the apertures in the base and guide members to effect reciprocation thereof within the channel of the guide member.

In its preferred form, the guide member and its channel are of substantially rectangular cross section, and the latch bolt is elongated and of substantially rectangular cross section. The guide member has deflectable tabs at the lower ends of the side walls resiliently bearing upon the lower surface of the latch bolt to seat it snugly within the channel of the guide member. These tabs are desirably inclined upwardly and inwardly and bear upon the latch bolt to provide limited frictional resistance to sliding movement in the channel.

Desirably, the actuator member has a depending leg extending through the apertures and engaged with the slide bolt to provide the engagement therebetween. In its preferred form, the slide bolt has an aperture in which the depending leg is seated. To avoid marring of the top wall of the housing, it has upstanding slide portions about the aperture therein to support the actuator member above the principal plane of the top wall.

The actuator member has a body portion substantially overlying the aperture in the top wall of the housing, and an actuator portion projecting thereabove for facile manipulation of the actuator member. The assembly additionally includes threaded fasteners for securing the assembly to a support surface, and these fasteners are seated in apertures in the top wall of the decorative housing and extend through aligned apertures in the top wall of the base member.

DETAILED DESCRIPTION OF THE ILLUSTRATED EMBODIMENT

Figure 1:
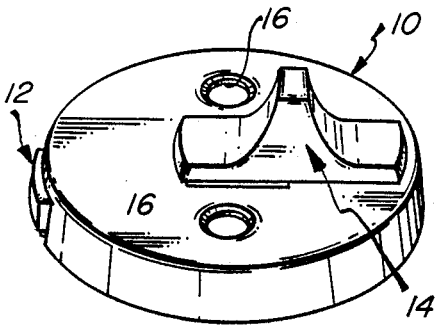
FIG. 1 is a perspective view of a surface-mounted decorative latch bolt assembly embodying the present invention and showing the latch bolt in the retracted position.
Figure 2:
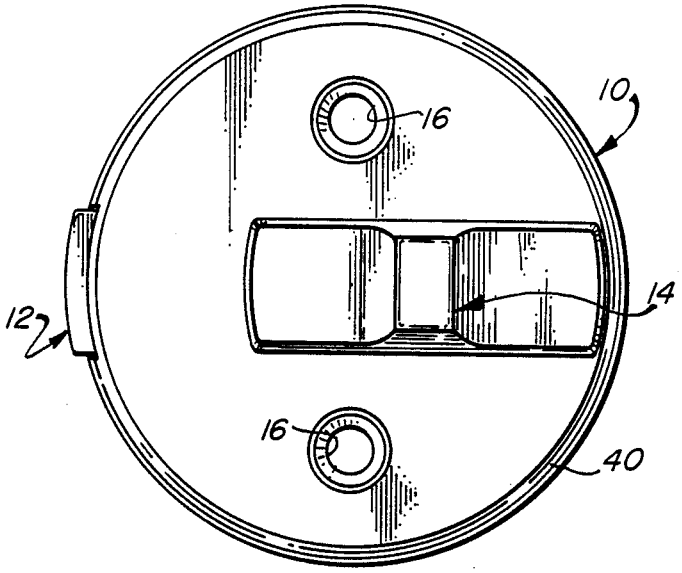
FIG. 2 is a top plan view thereof, drawn to a greatly enlarged scale.
Figure 3:
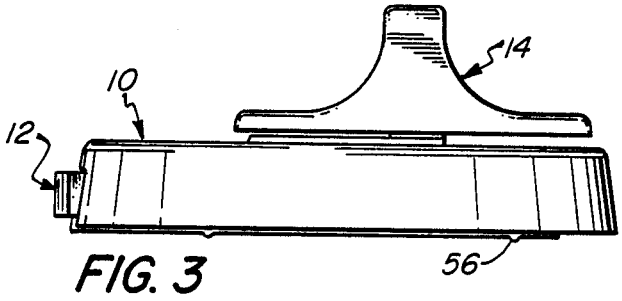
FIG. 3 is a side elevational view thereof drawn to the scale of FIG. 2.
Figure 4:
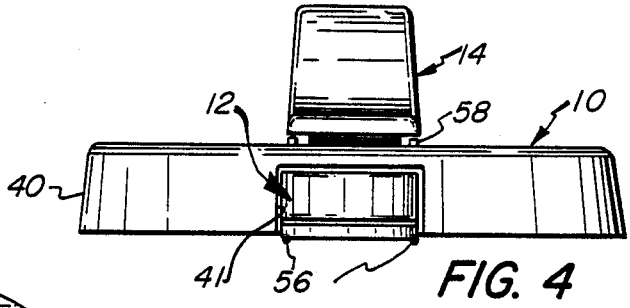
FIG. 4 is a front end elevational view thereof.
Figure 5:
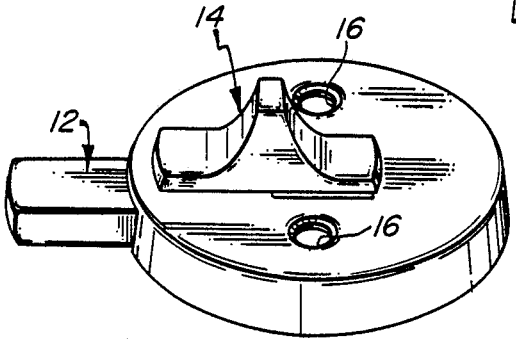
FIG. 5 is a perspective view similar to FIG. 1 drawn on the same scale, and showing the latch bolt in its extended position.

As seen in the attached drawings, a surface-mounted decorative latch bolt assembly embodying the present invention includes a highly decorative exterior housing generally designated by the numeral 10, and a latch bolt 12 generally designated by the numeral 12. The bolt 12 is retractable into the housing 10 and movable outwardly therefrom by manipulation of the actuator button or knob generally designated by the numeral 14 and which is slidably supported above the top wall of the housing 10. The entire assembly may be secured to a door or other surface (not shown) by fasteners 44 (seen in FIG. 6) seated in the apertures 16 and cooperates with a latch plate (not shown) having an aperture or recess in which the bolt 12 will engage.

Figure 6:
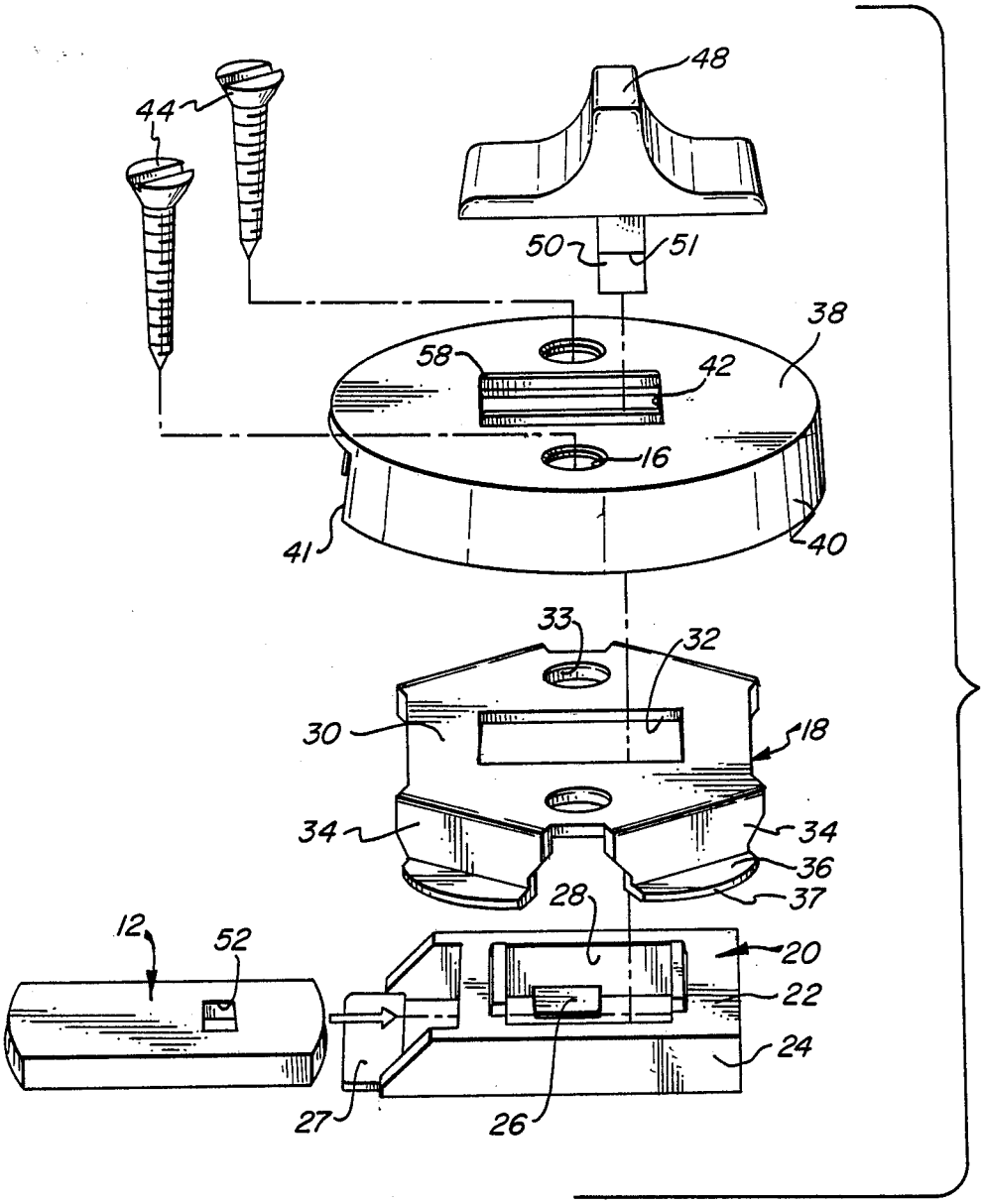
FIG. 6 is an exploded view of the latch bolt assembly with the leg of the actuator undeformed and additionally showing the threaded fasteners which have been omitted from the other views for clarity of illustration.
Figure 7:
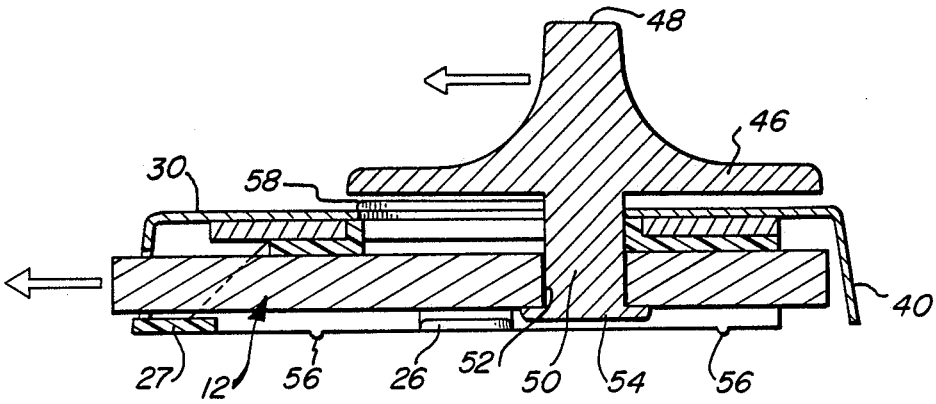
FIG. 7 is a sectional view of the assembly with the latch bolt in the retracted position, with arrows to indicate the direction of motion of the actuator knob and of the latch bolt.

As seen in FIGS. 6 and 7, the assembly includes a chassis generally designated by the numeral 18 and a guide member generally designated by the numeral 20. The guide member is intergally formed from a synthetic resin with a top wall 22, a pair of side walls 24 and upwardly inclined tabs 26 at the bottom of the side walls 24, and a transverse platform 27 extending between the forward end of the side walls 24. An elongated rectangular aperture 28 is provided in the top wall 22.

The chassis 18 has a top wall 30, four spaced, angularly oriented, depending side walls 34 and outwardly extending flanges 36 with arcuate outer edges 37 at the base of the side walls 34. In the top wall 30 is an elongated rectangular aperture 32 which is generally aligned with the aperture 28 in the guide member 20. Also provided in the top wall are fastener apertures 33 which are generally aligned with the apertures 16 in the housing 10. As will be readily appreciated, the chassis 18 defines an elongated channel extending longitudinally thereof and parallel to the rectangular aperture 32 and in which the guide member 20 is seated.

The guide member 20 also provides an elongated channel which is parallel to the channel defined by the chassis 18, and in it is seated the latch bolt 12. The channel defined by the guide number 20 is cooperatively configured and dimensioned with respect to the latch bolt 12 so that the latch bolt is snugly received therewithin between the top wall 22 and the tabs 26 which are resiliently deflectable and provide resilient biasing pressure on the bottom surface of the latch bolt 12. As best seen in FIG. 7, there are depending bosses 56 on the bottom of the side walls 24 which will provide some mechanical engagement with the support surface (not shown) upon tightening of the screws 58.

The housing 10 has a top wall 38 which as previously indicated has apertures 16 therein for the mounting fasteners 44, and an elongated aperture 42. The housing 10 also has a sidewall 40 which is provided with an opening 41 at the front end thereof in which is disposed the latch bolt 12. The opening 41 is slightly larger than the channel in the guide member 20 and latch bolt 12 so that the latch bolt 12 will move freely therethrough without coming into contact with the edges thereof.

The actuator knob 14 has a body portion 46 which overlies the elongated aperture 42 in the housing 10 and an upstandinng knob portion 48 for finger manipulation. Depending from the lower surface of the actuator 14 is a leg 50 which extends downwardly through the aperture 42 in the housing, the aperture 32 in the chassis 18, the aperture 28 in the guide member 20, and the aperture 52 in the latch bolt 12. The width of the leg 50 is reduced on the opposed faces extending parallel to the direction of movement to provide shoulders 51 against which the upper surface of the bolt 12 abuts. As seen in FIG. 7, the lower end of the leg 50 is deformed to provide a locking head 54 against the lower surface of the latch bolt 12 so as to secure the several elements in assembly.

As best seen in FIGS. 6 and 7, the actuator knob 14 is spaced slightly above the planar surface of the top wall 38 by the upturned lips 58 which extend along the longitudinal side margins of the aperture 42 and thus prevent scuffing or marring of the top surface.

As will be readily appreciated, the guide member 20 is readily molded from synthetic resins providing a relatively high degree of lubricity and resilient deflectablity such as acetals, polyamides, polypropylene, high density polyethylene, and the like. The latch bolt 12 is conventionally fabricated from metal so as to provide a high degree of durability and resistance to marring as well as security. The chassis 18 is preferably fabricated from metal although it too may be molded from synthetic resin if so desired.

The choice of materials for the housing 10 and actuator 14 will be normally dictated by the aesthetics desired. For a long lasting polished appearance, electroplated or polished metal will be preferred. For stylized appearance and variegated colors, synthetic resins may be preferred.

The elements are all readily fabricated and the mode of assembly can best be discerned from FIGS. 6 and 7. The latch bolt 12 is initially assembled within the channel of the guide member 20 and this sub-assembly is then introduced into the channel of the chassis 18. The housing 10 is then placed thereover with the apertures 42, 32 and 28 in registry. The leg 50 of the actuator knob 14 is inserted through the apertures and then through the aperture 52 in the bolt 12. The protruding portion of the leg 50 is then deformed to form the locking head 54, thus securing all the elements in assembly.

Thus, it can be seen from the foregoing description and the attached drawings that the decorative latch bolt assembly of the present invention is one which may be readily fabricated to provide a highly attractive structure which is secure in assembly. Moreover, the bolt will not rattle since it is firmly retained within the plastic guide member and it may be subjected to frictional pressures on its opposed surfaces to prevent its inadvertent movement although it may be moved readily by manipulation of the actuator.

I claim:

1. In a decorative surface-mounted latch bolt assembly, the combination comprising:

(a) a base member having a top wall and depending sidewalls defining a channel therebetween, said top wall having an aperture therein extending parallel to said channel;

(b) a guide member of synthetic resin seated in said channel of said base member, said guide member having a top wall and side walls extending parallel to said channel of said base member providing a channel extending parallel to said channel of said base member, said top wall of said guide member having an aperture therein aligned with said aperture of said base member;

(c) a latch bolt slidably seated in said channel of said guide member;

(d) a decorative housing having a top wall and a sidewall extending downwardly therefrom about said base member, said top wall having an aperture therein aligned with said apertures in said top walls of said base member and guide member, said sidewall providing an aperture aligned with one end of said channels and dimensioned and configured to permit said latch bolt to pass freely therethrough; and (e) an actuator member disposed above said top wall of said decorative housing and overlying said aperture therein, said actuator member being engaged with said latch bolt through said apertures in said base and guide members to effect reciprocation thereof within said channel of said guide member.

2. The surface-mounted latch bolt assembly in accordance with claim 1 wherein said guide member and its channel are of substantially rectangular cross section and wherein said latch bolt is elongated and of substantially rectangular cross section.

3. The surface-mounted latch bolt assembly in accordance with claim 1 wherein guide member has deflectable tabs at the lower ends of said side walls resiliently bearing upon the lower surface of said latch bolt to seat it snugly within the channel of said guide member.

4. The surface-mounted latch bolt assembly in accordance with claim 3 wherein said tabs are inclined upwardly and inwardly and bear upon said latch bolt to provide limited frictional resistance to sliding movement in its channel of said guide member.

5. The surface-mounted latch bolt assembly in accordance with claim 1 wherein said actuator member has a depending leg extending through said apertures and engaged with said slide bolt to provide the engagement therebetween.

6. The surface-mounted latch bolt assembly in accordance with claim 5 wherein said slide bolt has an aperture in which said depending leg is seated.

7. The surface-mounted latch bolt assembly in accordance with claim 5 wherein said top wall of said housing has upstanding glide portions about the aperture therein to support said actuator member above the principal plane of said top wall.

8. The surface-mounted latch bolt assembly in accordance with claim 1 wherein said actuator member has a body portion substantially overlying said aperture in said top wall of said housing and an actuator portion projecting thereabove for facile manipulation of said actuator member.

9. The surface-mounted latch bolt assembly in accordance with claim 1 wherein said assembly additionally includes threaded fasteners for securing said assembly to a support surface.

10. The surface-mounted latch bolt assembly in accordance with claim 9 wherein said fasteners are seated in apertures in said top wall of said decorative housing and extend through aligned apertures in the top wall of said base member.

11. In a decorative surface-mounted latch bolt assembly, the combination comprising:

(a) a base member having a top wall and depending sidewalls defining a channel therebetween, said top wall having an aperture therein extending parallel to said channel;

(b) a guide member of synthetic resin seated in said channel of said base member, said guide member having a top wall and side walls extending parallel to said channel of said base member and providing a channel extending parallel to said channel of said base member, said guide member and its channel being of substantially rectangular cross section, said top wall of said guide member having an aperture therein aligned with said aperture of said base member;

(c) a latch bolt slidably seated in said channel of said guide member, said latch bolt being elongated and of substantially rectangular cross section, said guide member having deflectable tabs at the lower ends of said side walls resiliently bearing upon the lower surface of said latch bolt to seat it snugly within said channel of said guide member;

(d) a decorative housing having a top wall and a sidewall extending downwardly therefrom about said base member, said top wall having an aperture therein aligned with said apertures in said top walls of said base member and guide member, said sidewall providing an aperture aligned with one end of said channels and dimensioned and configured to permit said latch bolt to pass freely therethrough; and (e) an actuator member disposed above said top wall of said decorative housing and overlying said aperture therein, said actuator member being engaged with said latch bolt through said apertures in said base and guide members to effect reciprocation thereof within said channel of said guide member.

12. The surface-mounted latch bolt assembly in accordance with claim 11 wherein said tabs are inclined upwardly and inwardly and bear upon said latch bolt to provide limited frictional resistance to sliding movement in its channel.

13. The surface-mounted latch bolt assembly in accordance with claim 1 wherein said top wall of said housing has upstanding glide portions about the aperture therein to support said actuator member above the principal plane of said top wall.

14. The surface-mounted latch bolt assembly in accordance with claim 11 wherein said assembly additionally includes threaded fasteners for securing said assembly to a support surface, and said fasteners are seated in apertures in said top wall of said decorative housing and extend through aligned apertures in the top wall of said base member.

* * * * *